US009258654B2

(12) United States Patent
He

(10) Patent No.: US 9,258,654 B2
(45) **Date of Patent: *Feb. 9, 2016**

(54) COIL

(71) Applicants: AAC Acoustic Technologies (Shenzhen) Co.,Ltd., Shenzhen (CN); AAC Microtech (Changzhou) Co.,Ltd., Changzhou (CN)

(72) Inventor: Jing He, Shenzhen (CN)

(73) Assignees: AAC ACOUSTIC TECHNOLOGIES (SHENZHEN) CO., LTD., Shenzhen (CN); AAC MICROTECH (CHANGZHOU) CO., LTD., Changzhou (CN)

( * ) Notice: Subject to any disclaimer, the term of this patent is extended or adjusted under 35 U.S.C. 154(b) by 129 days.

This patent is subject to a terminal disclaimer.

(21) Appl. No.: 13/858,294

(22) Filed: Apr. 8, 2013

(65) Prior Publication Data

US 2013/0266161 A1 Oct. 10, 2013

(30) Foreign Application Priority Data

Apr. 9, 2012 (CN) ..... 2012 2 0146629 U

(51) Int. Cl.
*H04R 25/00* (2006.01)

(52) U.S. Cl.
CPC ..... *H04R 25/00* (2013.01); *H04R 25/554* (2013.01); *H04R 2225/51* (2013.01)

(58) Field of Classification Search
CPC ..... H04R 25/00; H01F 5/003; H01F 17/0006; H01F 2017/006; H01F 27/2804; H01F 5/00
See application file for complete search history.

(56) References Cited

U.S. PATENT DOCUMENTS 5,537,482 A * 7/1996 Janning ..... 381/411
6,154,557 A * 11/2000 Montour et al. ..... 381/431

* cited by examiner

*Primary Examiner* — Duc Nguyen
*Assistant Examiner* — Taunya McCarty
(74) *Attorney, Agent, or Firm* — Anova Law Group, PLLC

(57) ABSTRACT

A coil for a transducer includes a pair of first sections, a second section connecting two ends of the first sections, and a third section connecting the other two ends of the first sections for forming a closed loop. The third section includes a pair of first stretch parts each extending from one first section toward the other stretch part, and a first concave part extending from the first stretch parts toward the second section.

10 Claims, 2 Drawing Sheets

COIL

FIELD OF THE INVENTION

The present disclosure generally relates to the art of coils, more particularly to a hearing aid coil (HAC) used in a transducer for generating sound.

RELATED ART OF THE INVENTION

As the market of portable consumer electronic products growing, electronic devices like mini speaker are widely used, and speakers combining hearing aid function are more and more demanded by users who are hearing-impaired. Usually a hearing aid coil is mounted in a speaker and helps users wearing hearing aid hear sound by electromagnetic induction with audiphones. A coil is generally made by winding metal wire or laser etching.

General speakers are regular shaped like square or circle, but nowadays, shapes of speakers are tend to be irregular. A regular coil may adapt a speaker well when the speaker is also regular, but when the speaker has an irregular shape, the regular coil cannot adapt to the speaker and it will limit the size of the coil thereby limiting the performance of the speaker.

Accordingly, it is necessary to provide an improved coil for solving the problems mentioned above.

DETAILED DESCRIPTION OF THE EXEMPLARY EMBODIMENTS

Reference will now be made to describe two exemplary embodiment of the present disclosure in detail.

Embodiment 1

Figure 1:
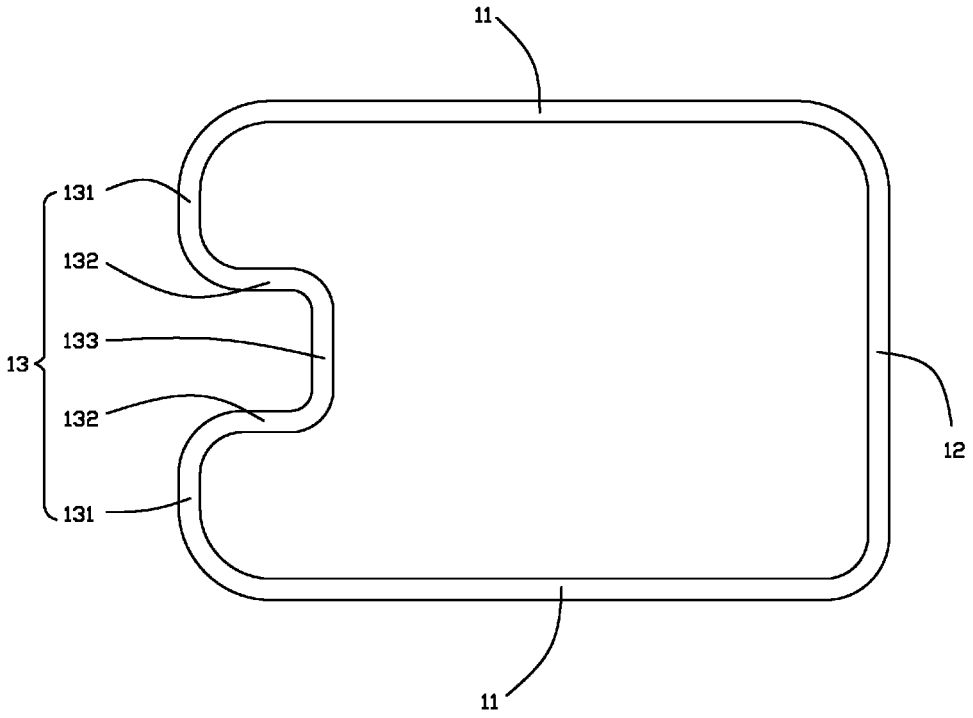
FIG. 1 is a top view of a coil in accordance with a first exemplary embodiment of the present disclosure.

Referring to FIG. 1, a coil 1, in accordance with a first exemplary embodiment of the present disclosure, includes a pair of first sections 11 parallel to each other, a second section 12 connecting two ends of the first borders 11, a third section 13 connecting the other two ends of the first sections 11 forming a closed loop. The third section 13 includes a pair of first portions 131 each extending from one first section 11 toward the other first portion, a pair of second portions 132 extending from the first portions 131 respectively toward the second section 12, and a connecting portion 133 connecting the two second portions 132. The second portion 132 and the connecting portion 133 cooperatively form a protrusion.

The second portions 132 are substantially parallel to the first sections 11, and the connecting portion 133 is substantially perpendicular to the first sections 11. The length of the connecting portion 133 is smaller than the length of the second section 12, and the length of the first section 11 is greater than the distance between the connecting portion 133 and the second section 12.

Embodiment 2

Figure 2:
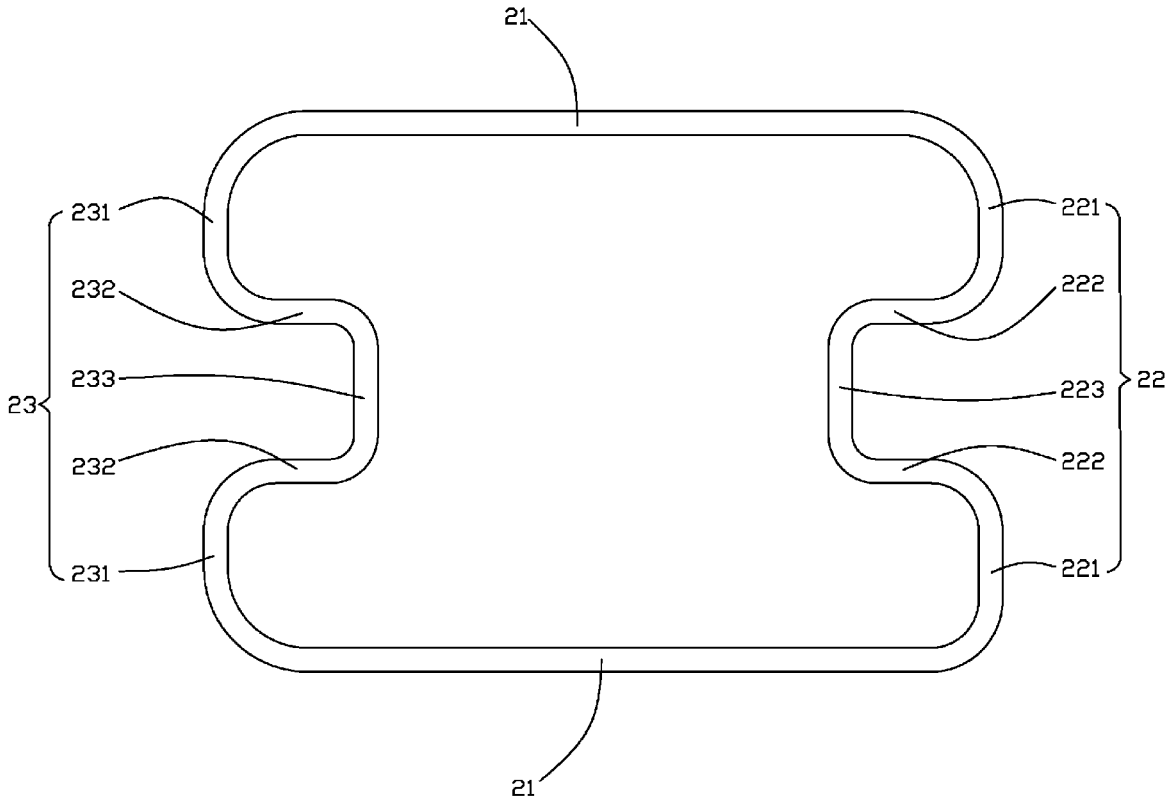
FIG. 2 is a top view of a coil in accordance with a second exemplary embodiment of the present disclosure.

Referring to FIG. 2, a coil 2, in accordance with a second exemplary embodiment of the present disclosure, includes a pair of first sections 21 parallel to each other, a second section 22 connecting two ends of the first sections 21, a third section 23 connecting the other two ends of the first sections 21 for forming a closed loop.

Similar to Embodiment 1, the third section 23 includes a pair of first portions 231 each extending from one first section 21 toward the other first portion, a pair of second portions 232 extending from the first portions 231 respectively toward the second section 22, and a first connecting portion 233 connecting the two second portions 232. The second portions 232 and the first connecting portion 233 cooperatively form a first concave part.

The second portions 232 are substantially parallel to the first sections 21, and the first connecting portion 233 is substantially perpendicular to the first sections 21.

Different from Embodiment 1, the second section 22 includes a pair of third portions 221 each extending from one first section 21 toward the other third portion, a pair of fourth portions 222 extending from the third portions 221 respectively toward the third section 23, and a second connecting portion 223 connecting the two fourth portions 222. The fourth portions 222 and the second connecting portion 223 cooperatively form a second concave part.

The fourth portions 222 are substantially parallel to the first sections 21, and the second connecting portion 223 is substantially perpendicular to the first sections 21.

The length of the first connecting portion 233 equals to the length of the second connecting portion 223. The length of the second connecting portion 223 is smaller than the distance between the first sections 21, the length of the first section 21 is greater than the distance between the first connecting portion 233 and the second connecting portion 223.

Optionally, the coil could be symmetrical graphics.

When a speaker is irregular, coil 1 or coil 2 can adapt to the shape of the speaker, thereby optimizing the performance of the speaker.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A hearing aid induction coil, comprising:

a pair of first sections of windings of the hearing aid induction coil spaced from each other, a second section of windings of the hearing aid induction coil connecting two ends of the first sections of windings of the hearing aid induction coil, a third section of windings of the hearing aid induction coil connecting the other two ends of the first sections of windings of the hearing aid induction coil for forming a closed loop, wherein, the third section of windings of the hearing aid induction coil includes a pair of first portions each extending substantially perpendicularly from each first section of windings of the hearing aid induction coil, the first portions extending toward each other in a straight line direction, and a protrusion connected between the first portions and protruding toward the second section of windings of the hearing aid induction coil.

2. The hearing aid induction coil of claim 1, wherein the protrusion comprises a pair of second portions extending substantially perpendicularly from the first portions toward the second section of windings of the hearing aid induction coil, and a connecting portion connected between the second portions.

3. The hearing aid induction coil of claim 2, wherein the first sections of windings of the hearing aid induction coil are substantially parallel to each other, and the second portions are substantially parallel to the first sections of windings of the hearing aid induction coil.

4. The hearing aid induction coil of claim 3, wherein the second section of windings of the hearing aid induction coil is substantially perpendicular to the first sections of windings of the hearing aid induction coil.

5. The hearing aid induction coil of claim 4, wherein the connecting portion is substantially parallel to the second section of windings of the hearing aid induction coil.

6. The hearing aid induction coil of claim 5, wherein a length of the connecting portion is smaller than a distance between the first sections of windings of the hearing aid induction coil, and a length of the first sections is greater than a distance between the connecting portion and the second section of windings of the hearing aid induction coil.

7. A hearing aid induction coil, comprising:

a pair of first sections of windings of the hearing aid induction coil substantially parallel to each other and spaced from each other;

a second section of windings of the hearing aid induction coil connected between two ends of the first sections of windings of the hearing aid induction coil;

a third section of windings of the hearing aid induction coil connecting the other two ends of the first sections of windings of the hearing aid induction coil for forming a closed loop; wherein, the third section of windings of the hearing aid induction coil includes a pair of first portions each extending substantially perpendicularly from one end of each first section of windings of the hearing aid induction coil, the first portions extending toward each other in a straight line direction, a pair of second portions extending from the first portions toward the second section of windings of the hearing aid induction coil and parallel to the first sections, and a first connecting portion connected between the second portions;

the second section of windings of the hearing aid induction coil includes a pair of third portions each extending substantially perpendicularly from the other end of each first section, the third portions extending toward each other in a straight line direction, a pair of fourth portions extending from the third portions toward the third section of windings of the hearing aid induction coil and parallel to the first sections, and a second connecting portion connected between the fourth portions.

8. The hearing aid induction coil of claim 7, wherein a length of the first connecting portion is equal to a length of the second connecting portion.

9. The hearing aid induction coil of claim 8, wherein the first connecting portion is substantially perpendicular to the first sections and substantially parallel to the second connecting portion.

10. The hearing aid induction coil of claim 9, wherein a distance between the first connecting portion and the second connecting portion is smaller than a length of the first sections.

* * * * *